US010694875B2

(12) United States Patent
Yan

(10) Patent No.: US 10,694,875 B2
(45) Date of Patent: Jun. 30, 2020

(54) PAPER CUP WITH STRAW

(71) Applicant: Taihang Yan, Hebei (CN)

(72) Inventor: Taihang Yan, Hebei (CN)

( * ) Notice: Subject to any disclaimer, the term of this patent is extended or adjusted under 35 U.S.C. 154(b) by 0 days.

(21) Appl. No.: 16/364,485

(22) Filed: Mar. 26, 2019

(65) Prior Publication Data

US 2020/0121104 A1 Apr. 23, 2020

(30) Foreign Application Priority Data

Oct. 17, 2018 (CN) ..... 2018 1 1211025

(51) Int. Cl.
*B65D 3/04* (2006.01)
*A47G 19/22* (2006.01)
*B65D 3/28* (2006.01)

(52) U.S. Cl.
CPC ..... *A47G 19/2266* (2013.01); *B65D 3/04* (2013.01); *B65D 3/28* (2013.01)

(58) Field of Classification Search
CPC . B65D 3/04; B65D 3/28; B65D 1/265; B65D 3/06; B65D 77/286; B65D 77/28; A47G 19/2266; A47G 19/2272
USPC ..... 229/400, 103.1, 405; 220/710; 206/217
See application file for complete search history.

(56) References Cited

U.S. PATENT DOCUMENTS 3,921,889 A * 11/1975 Gibbons ..... A47G 19/2266 229/103.1
5,137,210 A * 8/1992 Hibbs ..... B65D 81/3205 229/120.18
5,423,476 A * 6/1995 Ferrer ..... A47G 19/2272 229/103.1
5,495,982 A * 3/1996 Wang ..... B65D 5/3685 229/103.1
6,155,478 A * 12/2000 Yang ..... B65D 3/28 229/103.1
6,616,033 B1 * 9/2003 Schein ..... B65D 77/12 229/103.1
6,648,217 B2 * 11/2003 Schein ..... B65D 77/12 229/103.1
8,939,349 B2 * 1/2015 Lerner ..... A47G 19/2266 206/217
10,377,550 B1 * 8/2019 Tseng ..... B65D 3/28
2013/0240544 A1 * 9/2013 Lerner ..... A47G 19/2266 220/710

* cited by examiner

*Primary Examiner* — Christopher R Demeree

(57) ABSTRACT

The present invention discloses a paper cup with straw. The paper cup comprises a sectioned-ring-shaped paper sheet for making a cup body and a round paper sheet for making a cup bottom. The sectioned-ring-shaped paper sheet and the round paper sheet are affixed to form the paper cup. An edge of a top arch of the sectioned-ring-shaped paper sheet is provided with at least one protruding rectangular paper sheet that is integrally formed with the sectioned-ring-shaped paper sheet. An edge of a bottom arch of the sectioned-ring-shaped paper sheet is provided with at least one notch corresponding to the protruding rectangular paper sheet. The protruding rectangular paper sheet is rolled via a cylindrical mold to form an upper portion of a straw. A lower portion of the straw is connected to a receiving room of the paper cup via the notch.

2 Claims, 5 Drawing Sheets

PAPER CUP WITH STRAW

CROSS-REFERENCE TO PRIOR APPLICATION

This application claims the benefit of Chinese Patent Application No. 201811211025.0 filed on Oct. 17, 2018, the contents of which are incorporated herein by reference.

FIELD OF THE INVENTION

The present invention relates to housewares, specifically to a paper cup.

BACKGROUND OF THE INVENTION

Plastic straws are commonly used and preferred when people are drinking beverages out of paper cups. The rationale behind drinking through straws relies on atmospheric pressure. When sucking out part of the air in a straw the air pressure above the liquid in the straw is reduced, whereupon atmospheric pressure forces the liquid through the straw in order to balance the air pressure. When the suction stops, the liquid in the straw goes back to the original water level, the air pressure is thus restored to balance. This is how a straw works.

However straws have made quite an environmental impact recently, proposal to ban on plastic straws becomes heated as it is significant to boycotting single-use plastic products. Plastic straw accounts for the sixth commonly seen waste in the world and one of the ten oceanic pollutions. Campaigns are launched for encouraging people to use less plastic straws. It is estimated that the earth is expected to have 12 billion tons of plastic waste by the year of 2050, almost 9 million tons of which will be emitted into the ocean. These plastic wastes include plastic bags, plastic bottles, plastic wraps as well as plastic straws. Plastic straws account only for 4% of plastic waste in the world, but they contribute to 2 thousand tons of pollutions. In addition, plastic straws are regarded as the ultimate waste produced by human beings as they are barely recyclable and of low recycling value. Therefore plastic straws are still lethal to the oceans regardless of its low proportion among overall plastic productions and its small size. With the promotion of the environmental protection concept, everyone's mind has more or less the protection awareness of the green earth and the blue ocean. And such a beautiful and far-reaching idea may start with an attitude towards a straw.

SUMMARY OF THE INVENTION

The embodiments of the present invention aim at providing a paper cup with straw so as to resolve the above-mentioned problems arising from using plastic straws.

In order to realize the above-mentioned goals, the embodiments of the present invention provide a paper cup with straw. The paper cup with straw comprises a sectioned-ring-shaped paper sheet for making a cup body and a round paper sheet for making a cup bottom. The sectioned-ring-shaped paper sheet and the round paper sheet are affixed to form the paper cup. An edge of a top arch of the sectioned-ring-shaped paper sheet is provided with at least one protruding rectangular paper sheet that is integrally formed with the sectioned-ring-shaped paper sheet. An edge of a bottom arch of the sectioned-ring-shaped paper sheet is provided with at least one notch corresponding to the protruding rectangular paper sheet. The protruding rectangular paper sheet is rolled via a cylindrical mold to form an upper portion of a straw. A lower portion of the straw is connected to a receiving room of the paper cup via the notch.

Preferably, the edge of the top arch of the sectioned-ring-shaped paper sheet is provided with a left-side protruding rectangular paper sheet and a right-side protruding rectangular paper sheet that are symmetrically arranged. And the edge of the bottom arch of the sectioned-ring-shaped paper sheet is provided with at least one notch.

Preferably, the edge of the bottom arch of the sectioned-ring-shaped paper sheet is provided with a right-side notch. The left-side protruding rectangular paper sheet and a first strip portion of the sectioned-ring-shaped paper sheet together are pressed by the cylindrical mold to form at least one outwardly-arched curved portion of the straw. The right-side protruding rectangular paper sheet and a second strip portion of the sectioned-ring-shaped paper sheet together are pressed by the cylindrical mold to form at least one inwardly-arched curved portion of the straw. The second strip portion of the sectioned-ring-shaped paper sheet is arranged between the right-side protruding rectangular paper sheet and the notch. The outwardly-arched curved portion of the straw and the inwardly-arched curved portion of the straw are affixed to form an inner space of the straw; the inner space of the straw communicates with the receiving room of the paper cup via the right-side notch.

Preferably, the left-side or the right-side protruding rectangular paper sheet has a height of 10 mm to 100 mm.

Preferably, the left-side protruding rectangular paper sheet and the right-side protruding rectangular paper sheet are respectively arranged on two extreme edge portions of the edge of the top arch of the sectioned-ring-shape paper sheet, a left-side notch and a right-side notch are correspondingly arranged on two extreme edge portions of the edge of the bottom arch of the sectioned-ring-shaped paper sheet. The left-side protruding rectangular paper sheet and a third strip portion of the sectioned-ring-shaped paper sheet between the left-side protruding rectangular paper sheet and the left-side notch together are pressed by the cylindrical mold to form a left-side straw, the left-side straw communicates with the receiving room of the paper cup through the left-side notch. The right-side protruding rectangular paper sheet and a fourth strip portion of the sectioned-ring-shaped paper sheet between the right-side protruding rectangular paper sheet and the right-side notch together are pressed by the cylindrical mold to form a right-side straw, the right-side straw communicates with the receiving room of the paper cup through the right-side notch. The left-side straw and the right-side straw are affixed together.

Preferably, the upper portion of the straw that is above the paper cup is made as a concertina-type hinge to be bendable for convenience.

Embodiments of the present invention possess the following merits:

The paper cup provided in embodiments of the present invention is integrally formed by the rolled paper straw and the cup body and no additional straw is needed, which thereby eliminates the problem of environmental pollution caused by the consumption of plastic straws. In addition, since paper straws are environmentally-friendly, they will be degraded to disappear into the soil after several months of use and will not pollute the environment.

LIST OF REFERENCE NUMERALS

Figure 1:
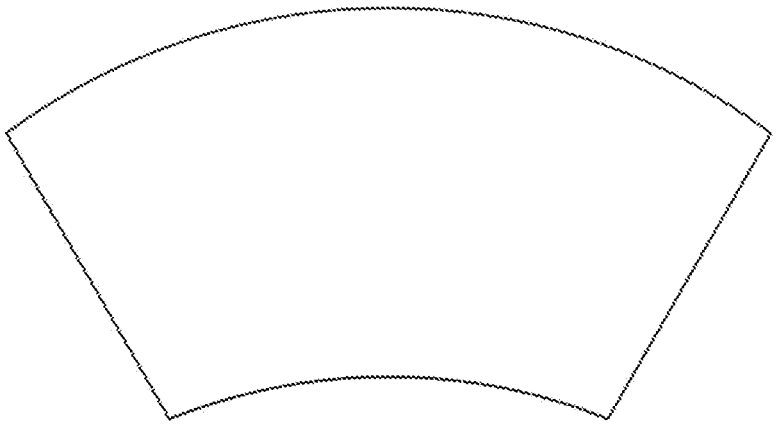
FIG. 1 is a schematic view of a sectioned-ring-shaped paper used in a conventional paper cup.

1. sectioned-ring-shaped paper sheet
11. protruding rectangular paper sheet
111. outwardly-arched curved portion
112. inwardly-arched curved portion
113. first strip portion
114. second strip portion
115. third strip portion
116. fourth strip portion
12. notch
2. round paper sheet
3. edge of top arch of sectioned-ring-shaped paper sheet
4. edge of bottom arch of sectioned-ring-shaped paper sheet

DETAILED DESCRIPTION OF ILLUSTRATED EMBODIMENTS

The methods of carrying out the present invention are described below by way of specific embodiments. And those skilled in the art are able to understand other advantages and functions of the present invention from the disclosure.

It should be understood that the structures, the proportions, and the sizes illustrated in the drawings are only used for supporting the contents disclosed in the specification so as to give the skilled in the art a better understanding. These conditions are not intended to limit the implementation of the present invention therefore are not technically meaningful. Any modifications to the structure, changes to the proportion or adjustments to the size, on the premises of not affecting the effects and the achievable objects of the present invention, are able to fall within the scope of the technical content disclosed in the present invention. In the meantime, the terms 'upper', 'lower', 'left', 'right', 'intermediate', and the like, are used in this specification for convenience of description only, and are not intended to limit the scope of the present invention. Changes or adjustments to the relative positions are considered to be within the scope of the present invention without substantial changes.

Embodiment 1

Figure 2:
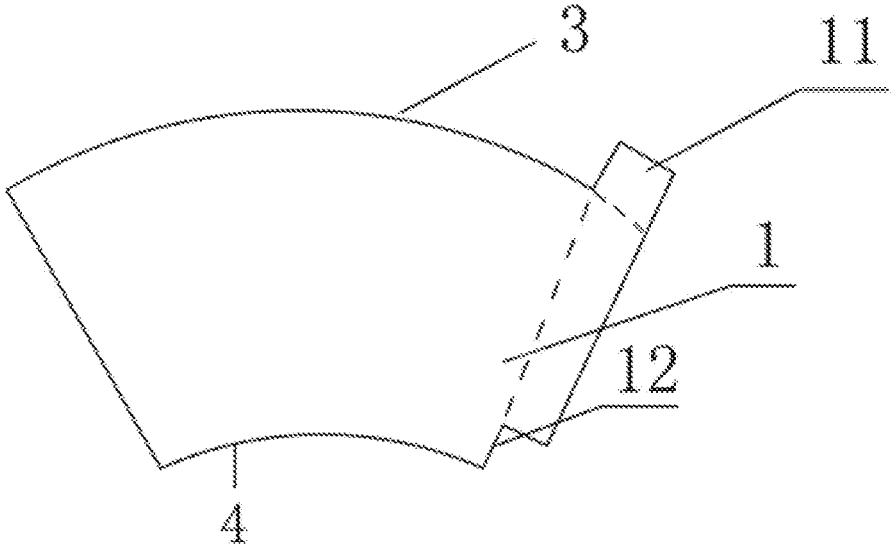
FIG. 2 is a structural schematic view of the sectioned-ring-shaped paper sheet of a paper cup according to embodiment 1 of the present invention, wherein the sectioned-ring-shaped paper sheet is unfolded.
Figure 3:
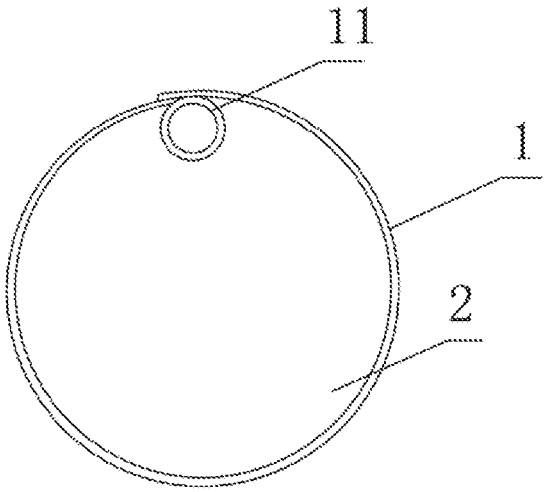
FIG. 3 is a schematic top plan view of the paper cup according to embodiment 1.
Figure 4:
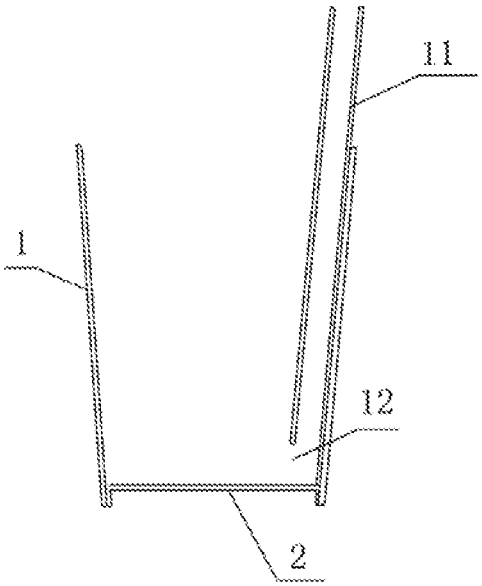
FIG. 4 is a cross-sectional view showing the paper cup according to embodiment 1 of the present invention.

FIG. 1 is a sectioned-ring-shaped paper sheet used for making conventional cups. FIG. 2 to FIG. 4 provide a paper cup of embodiment 1. FIG. 2 is a sectioned-ring-shaped paper sheet 1 used for making the paper cup provided in the present embodiment. Referring to FIG. 2, an edge 3 of a top arch of the sectioned-ring-shaped paper sheet 1 is provided with a protruding rectangular paper sheet 11 that is integrally formed with the sectioned-ring-shaped paper sheet 1. The protruding rectangular paper sheet 11 could be of any height within the range of 10 mm-100 mm. An edge 4 of a bottom arch of the sectioned-ring-shaped paper sheet 1 is provided with a notch 12 corresponding to the protruding rectangular paper sheet 11. FIG. 3 provides a schematic top plan view of the paper cup, wherein the sectioned-ring-shaped paper sheet 1 is rolled and affixed. The protruding rectangular paper sheet 11 is rolled via a cylindrical mold to form an upper portion of a straw; an outer surface of the straw and an inner surface of the paper cup are then adhered by glue. Referring to FIG. 4, a lower portion of the straw is connected to a receiving room of the paper cup via the notch 12. The paper cup provided in the embodiment of the present invention is integrally formed by the rolled paper straw and a cup body, which requires no additional straw and solve the problem of environmental pollution caused by the consumption of plastic straws.

Embodiment 2

Figure 5:
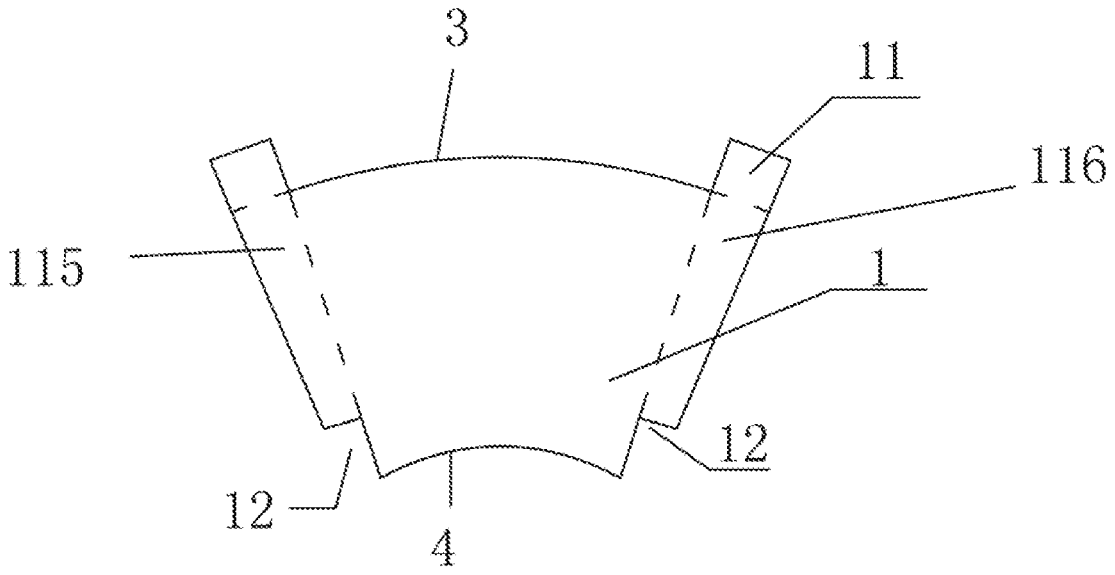
FIG. 5 is a structural schematic view of a sectioned-ring-shaped paper sheet of a paper cup according to embodiment 2 of the present invention after being unfolded.
Figure 6:
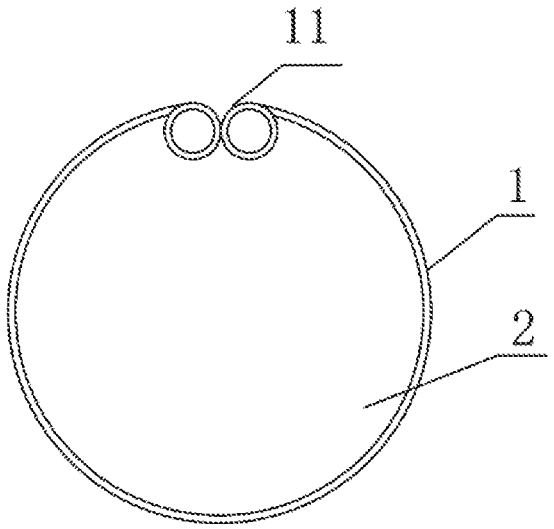
FIG. 6 is a schematic top plan view showing the paper cup according to embodiment 2 of the present invention.

FIG. 5 and FIG. 6 provide a second embodiment of a paper cup. Referring to FIG. 5, the differences between the sectioned-ring-shaped paper sheet 1 of Embodiment 1 and Embodiment 2 are that: in Embodiment 2, a left-side protruding rectangular paper sheet 11 and a right-side protruding rectangular paper sheet 11 are respectively arranged on two extreme edge portions of the edge 3 of the top arch of the sectioned-ring-shaped paper sheet 1, a left-side notch 12 and a right-side notch 12 are correspondingly arranged on two extreme edge portions of the edge 4 of the bottom arch of the sectioned-ring-shaped paper sheet 1. The two protruding rectangular paper sheets 11 are rolled into via the cylindrical mold to form two upper portions of straws. The outer surfaces of the two straws are adhered by glue. The lower portions of the two straws are connected to the receiving room of the paper cup via the notch 12. The present embodiment achieves the object of large consumption of drinks by way of providing two rolled straws.

Embodiment 3

Figure 7:
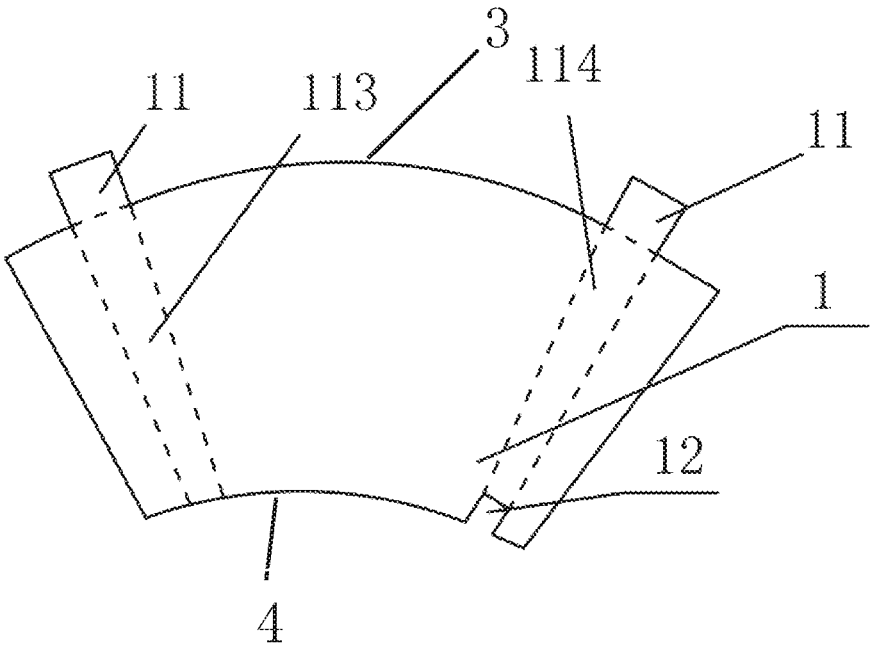
FIG. 7 is a structural schematic view of a sectioned-ring-shaped paper sheet of a paper cup according to embodiment 3 of the present invention after being unfolded.
Figure 8:
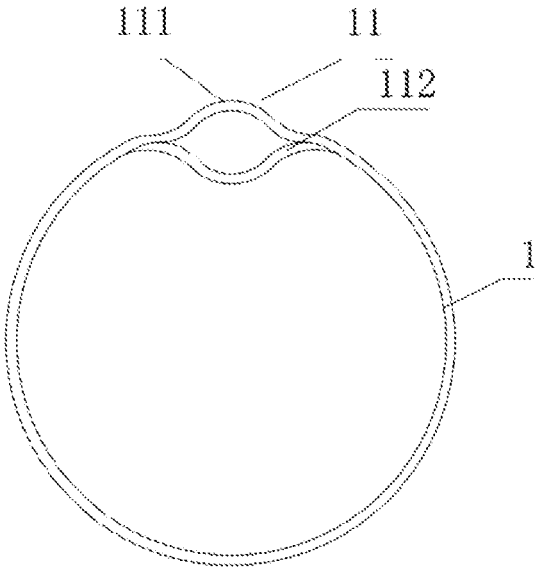
FIG. 8 is a schematic top plan view of the paper cup according to embodiment 3 of the present invention.

FIG. 7 and FIG. 8 provide a third embodiment of a paper cup. Referring to FIG. 7, the paper cup comprises a sectioned-ring-shaped paper sheet 1 for making a cup body and a round paper sheet for making a cup bottom, the sectioned-ring-shaped paper sheet 1 and the round paper sheet being affixed to form the paper cup. An edge 3 of a top arch of the sectioned-ring-shaped paper sheet 1 is provided with a left-side protruding rectangular paper sheet 11 and a right-side protruding rectangular paper sheet 11, which both are integrally formed with the sectioned-ring-shaped paper sheet 1. An edge 4 of a bottom arch of the sectioned-ring-shaped paper sheet 1 is provided with a right-side notch 12 corresponding to the right-side protruding rectangular paper sheet 11. Referring to FIG. 8, the left-side protruding rectangular paper sheet 11 and a first strip portion 113 of the sectioned-ring-shaped paper sheet 1 together are pressed by the cylindrical mold to form at least one outwardly-arched curved portion 111 of the straw. The right-side protruding rectangular paper sheet 11 and a second strip portion 114 of the sectioned-ring-shaped paper sheet 1 together are pressed by the cylindrical mold to form at least one inwardly-arched curved portion 112 of the straw, wherein the second strip portion 114 of the sectioned-ring-shaped paper sheet 1 is arranged between the right-side protruding rectangular paper sheet 11 and the right-side notch 12. The outwardly-arched curved portion 111 of the straw and the inwardly-arched curved portion 112 of the straw are affixed to form an inner space of the straw; the inner space of the straw communicates with the receiving room of the paper cup via the right-side notch 12. The paper cup provided in the present embodiment is integrally formed by the rolled paper straw and the cup body. Since paper straws are environmentally-friendly, they will be degraded to disappear into the soil after several months of use and will not pollute the environment.

Embodiment 4

Figure 9:
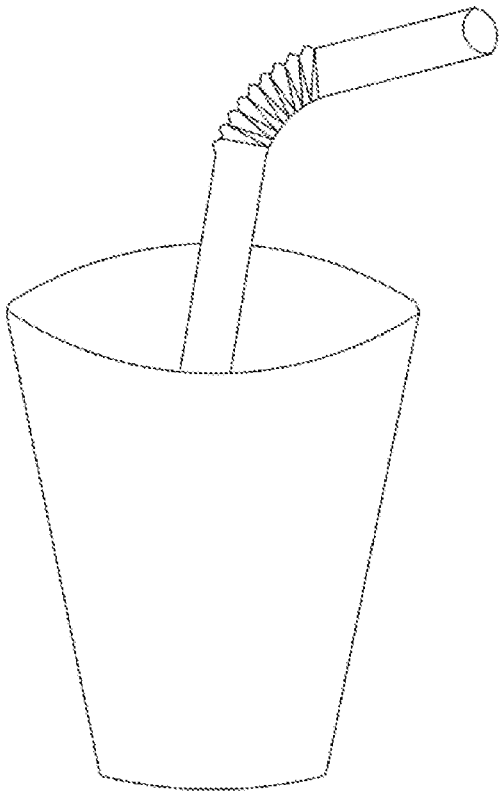
FIG. 9 is a schematic view of a paper cup with a top of a straw forming as a concertina-type hinge according to embodiment 4 of the present invention.

FIG. 9 provides a basically same embodiment as embodiment 1. The only difference is that a top of the protruding rectangular paper sheet 11 is pressed with multiple folds through a mold. When rolling the protruding rectangular paper sheet 11 into a straw, the top of the straw will form as a concertina-type hinge allowing the top of the straw to bend for convenience.

The above-mentioned embodiments are the preferred embodiments of the present invention. Variations and modifications are allowed within the scope of the invention. Those skilled in the art will appreciate that the features described above can be combined in various ways to form multiple variations of the invention. As a result, such variations fall within the scope of the protection to the present invention.

What is claimed is:

1. A paper cup with straw comprising a sectioned-ring-shaped paper sheet (1) for making a cup body and a round paper sheet (2) for making a cup bottom, the sectioned-ring-shaped paper sheet (1) and the round paper sheet (2) being affixed to form the paper cup;

wherein a left-side protruding rectangular paper sheet (11) and a right-side protruding rectangular paper sheet (11) are symmetrically arranged on two extreme edge portions of an edge (3) of a top arch of the sectioned-ring-shaped paper sheet (1), the left-side protruding rectangular paper sheet (11) and the right-side protruding rectangular paper sheet (11) are integrally formed with the sectioned-ring-shaped paper sheet (1), a left-side notch (12) and a right-side notch (12) are correspondingly arranged on two extreme edge portions of an edge (4) of a bottom arch of the sectioned-ring-shaped paper sheet (1);

the left-side protruding rectangular paper sheet (11) and a strip portion (115) of the sectioned-ring-shaped paper sheet (1) between the left-side protruding rectangular paper sheet (11) and the left-side notch (12) together are pressed by a cylindrical mold to form a left-side straw, the left-side straw communicates with a receiving room of the paper cup through the left-side notch (12);

the right-side protruding rectangular paper sheet (11) and a strip portion (116) of the sectioned-ring-shaped paper sheet (1) between the right-side protruding rectangular paper sheet (11) and the right-side notch (12) together are pressed by the cylindrical mold to form a right-side straw, the right-side straw communicates with the receiving room of the paper cup through the right-side notch (12);

the left-side straw and the right-side straw are affixed together;

upper portions of the left-side straw and the right-side straw that are above the paper cup are made as concertina-type hinges to be bendable for convenience.

2. The paper cup with straw according to claim 1, wherein the left-side or the right-side protruding rectangular paper sheet (11) has a height of 10 mm to 100 mm.

* * * * *